US006080020A

United States Patent [19]

Grabbe

[11] Patent Number: 6,080,020

[45] Date of Patent: Jun. 27, 2000

[54] GROUND PLANE FOR A FILTERED ELECTRICAL CONNECTOR

[75] Inventor: Dimitry Grabbe, Middletown, Pa.

[73] Assignee: The Whitaker Corporation, Wilmington, Del.

[21] Appl. No.: 09/087,207

[22] Filed: May 28, 1998

[51] Int. Cl.[7] ..... H01R 13/66

[52] U.S. Cl. ..... 439/620

[58] Field of Search ..... 439/620, 608, 439/108, 95, 607, 941; 333/182, 183, 181, 184; 361/328, 329, 330, 302

[56] References Cited

U.S. PATENT DOCUMENTS

| | | | |
|---|---|---|---|
| 3,710,285 | 1/1973 | Schor et al. | 333/79 |
| 3,744,001 | 7/1973 | Schor | 339/14 R |
| 3,753,168 | 8/1973 | Schor | 333/70 S |
| 3,961,295 | 6/1976 | Hollyday et al. | 333/79 |
| 4,707,048 | 11/1987 | Gliha et al. | 439/620 |
| 4,741,710 | 5/1988 | Hogan et al. | 439/620 |
| 4,747,789 | 5/1988 | Gliha | 439/620 |
| 4,768,977 | 9/1988 | Gliha, Jr. et al. | 439/620 |
| 4,792,320 | 12/1988 | Hori et al. | 439/620 |
| 4,952,896 | 8/1990 | Dawson, Jr. | 333/182 |
| 4,979,904 | 12/1990 | Francis | 439/108 |
| 5,018,990 | 5/1991 | Sakamoto et al. | 439/620 |
| 5,112,253 | 5/1992 | Swift | 439/620 |
| 5,149,274 | 9/1992 | Gallusser et al. | 439/76 |
| 5,248,266 | 9/1993 | Clyatt, III et al. | 439/620 |
| 5,257,949 | 11/1993 | Paulus | 439/620 |
| 5,280,257 | 1/1994 | Cravens et al. | 333/182 |
| 5,286,224 | 2/1994 | Paulus | 439/620 |
| 5,336,115 | 8/1994 | Paulus | 439/620 |
| 5,441,425 | 8/1995 | Kitamura | 439/620 |
| 5,586,912 | 12/1996 | Eslampour et al. | 439/620 |

*Primary Examiner*—Paula Bradley
*Assistant Examiner*—Ross Gushi

[57] ABSTRACT

An improved ground plane for use in an electrical connector features a plurality of contact receiving openings (64) which are stamped into a sheet of conductive material. A spring contact (65) is disposed adjacent each opening (64) and is positioned to undergo both torsional and cantilever beam deformation upon insertion of a filter element (50) in order to urge the filter element (50) against a reference surface (66).

16 Claims, 4 Drawing Sheets

GROUND PLANE FOR A FILTERED ELECTRICAL CONNECTOR

FIELD OF THE INVENTION

This invention is related to electrical connectors and more particularly to a ground plane for use in a filtered electrical connector.

BACKGROUND OF THE INVENTION

In high frequency applications, it is often necessary to provide filtering in order to maintain signal integrity. The filtering can be accomplished by capacitively coupling each signal line passing through a connector to a common ground plane. The capacitive coupling can be accomplished in a number of ways including the use of chip capacitors or tubular filter components which surround each signal pin. One example of such tubular filter components is shown in U.S. Pat. No. 3,710,285. In this patent Schor et al. teach a plurality of ground planes which establish a low impedance ground return circuit for a filter pin connector having a connector pin, a tubular filter, and a housing. The ground planes consist of thin metal sheets which are in electrical contact with the outer surface of the tubular filter and are sandwiched between various insulators of the housing. Here the electrical contact between the tubular filter and the ground plane is formed by spring contact means therebetween. A problem exists with this interface in that precise center pin to center pin alignment is difficult to achieve due to the tubular filter diameter tolerances and the spring means which is used to make the electrical contact.

An alternate approach to forming this electrical connection is shown in U.S. Pat. No. 4,952,896. Here, the filter components are soldered to the ground plane. A problem exists with this arrangement in that the soldering operation may cause short circuits between adjacent pins, flux entrapment, or fractured contact interfaces. All of these problems reduce the effective yield of the finished connectors.

SUMMARY

It is therefore an object of the present invention to provide an improved electrical interface between filter components and a ground plane which will achieve reliable electrical connections and proper pin to pin alignment.

This and other objects have been achieved by providing an improved ground plane for use in an electrical connector. The improved ground plane consists of a plurality of openings formed in the planar surface. A plurality of spring members is also formed in a planar surface. Each spring member is formed adjacent a respective opening and has a contact point for engaging an inserted filter component at a single location to urge each respective filter component towards a reference surface of its respective opening.

BRIEF DESCRIPTION OF THE DRAWINGS

The invention will now be described by way of example with reference to the accompanying Figures of which.

DETAILED DESCRIPTION OF THE EMBODIMENTS

Figure 1:
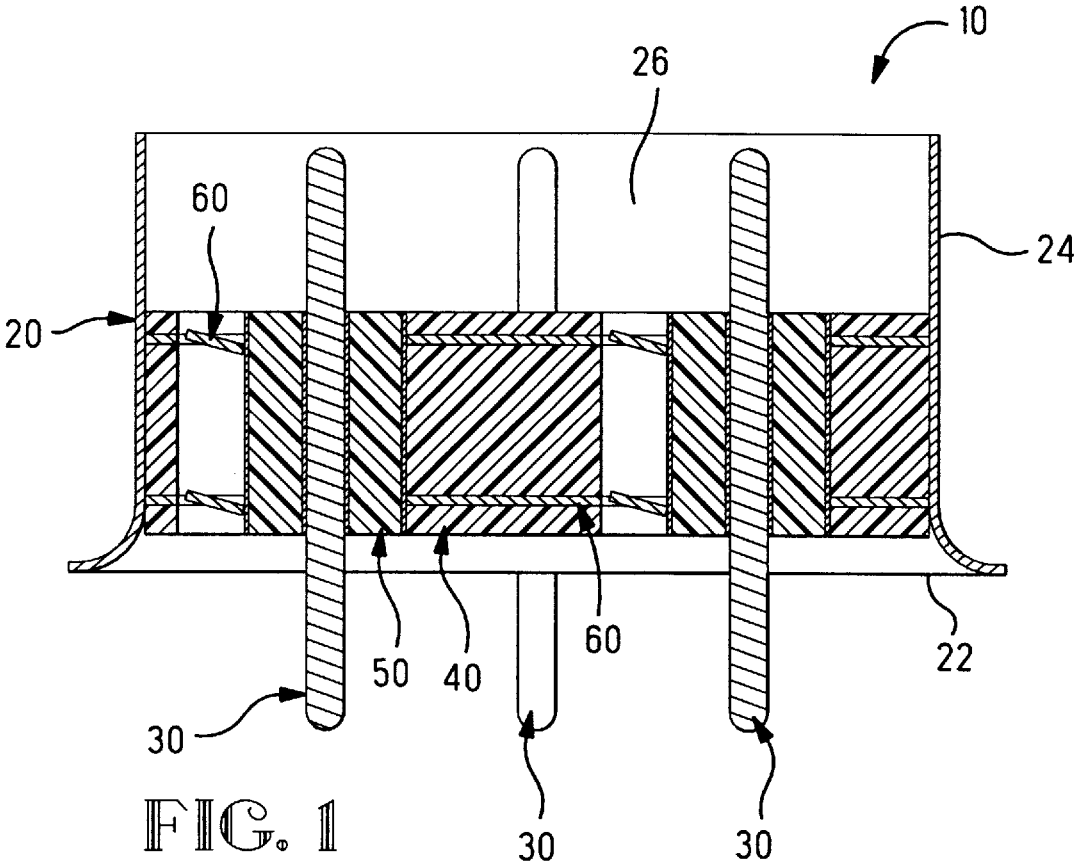
FIG. 1 shows a cross sectional view of an electrical connector utilizing a pair of the ground planes according to the present invention.

The invention will first be described generally with reference to FIG. 1. The electrical connector (10) consists of a metallic housing (20), a dielectric spacer (40) which has a plurality of passages to accommodate tubular filter components (50) which surround signal pins (30). A pair of ground planes (60) are disposed within the dielectric spacer (40) and have a plurality of corresponding filter receiving openings (64) to accommodate the filter components (50).

Each of the major components will now be described in greater detail with reference to FIGS. 2–6. Beginning with FIGS. 1 and 2, it can be seen that the conductive housing (20) consists of a face plate (22) from which a mating section (24) extends in a mating direction. The mating section (24) forms an enclosed interface area (26). A pair of jack screw openings (28) are formed in the face plate (22) along opposite sides of the interface area (26).

Figure 3:
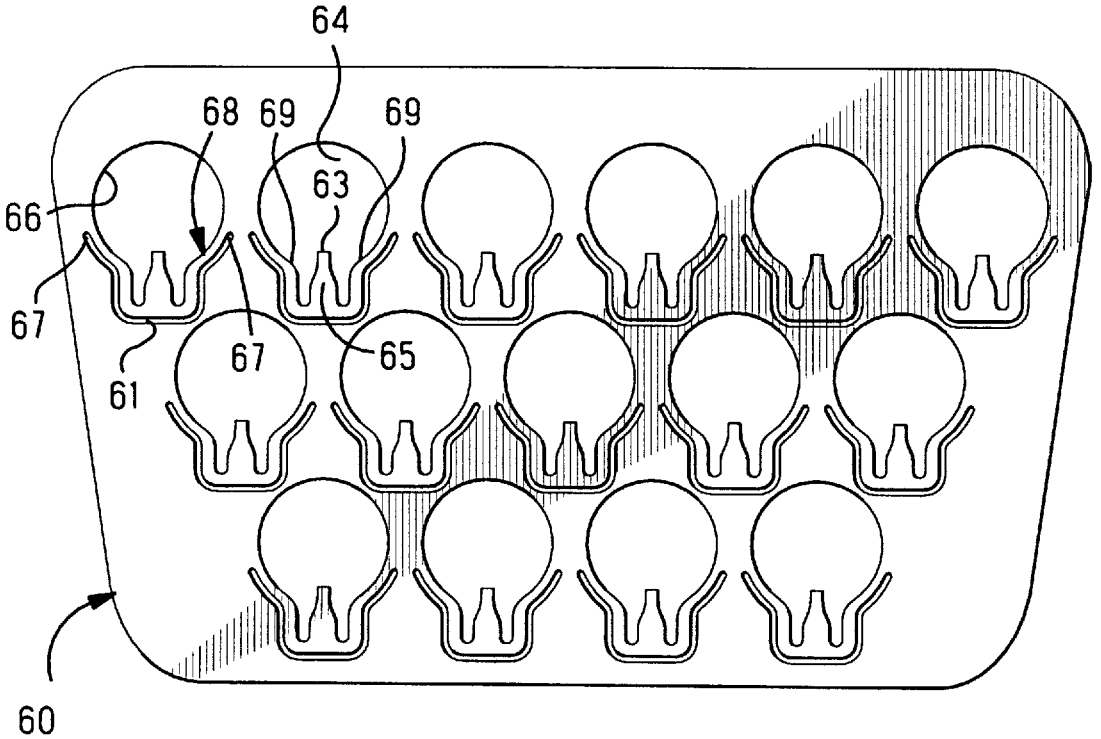
FIG. 3 shows a front end view of an ground plane utilized in a connector of FIG. 1.

Referring now to FIG. 3, the ground plane (60) is shown as viewed from the front end. This ground plane (60) is formed from a plate of metal which is simply stamped to form a plurality of filtered contact receiving openings (64) in a desired relationship to each other. Each opening (64) consists of a reference surface (66) opposite a spring member (68), each spring member being defined by a slot (61) and the opening (64) and being disposed therebetween. Each spring member (68) has a pair of torsional sections (69) adjacent a pair of attachment points (67). The generally W shaped spring member (68) has a contact tip (63) disposed approximately midway between the torsional sections (69) and extending into the opening (64).

Figure 4:
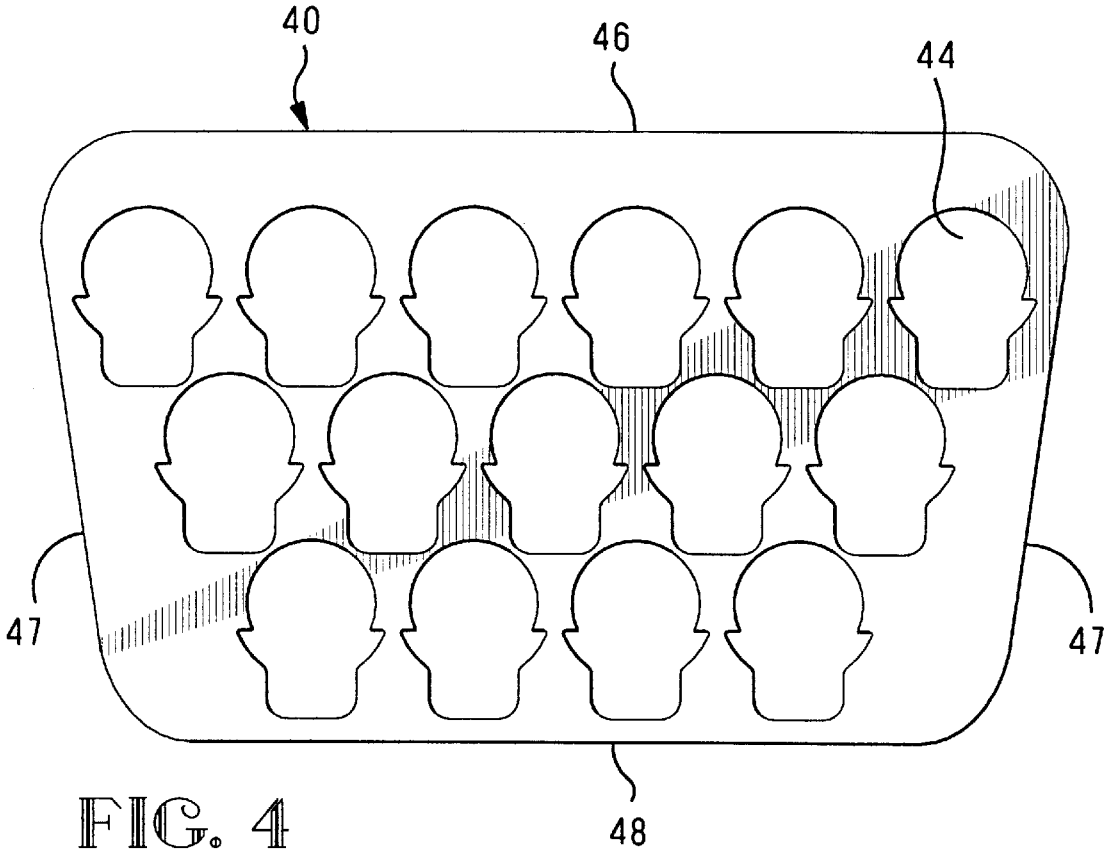
FIG. 4 shows a front end view of a dielectric spacer utilizing the electrical connector of FIG. 1.

Referring now to FIG. 4 the spacer (40) will be described in greater detail. The spacer (40) is formed of a dielectric material and features a plurality of contact receiving passages (44) which extend through the spacer (40). The spacer (40) may be optionally profiled to have a slot extending therethrough from a top end (46) to the bottom end (48) for receiving the ground plane (60). Optionally, the spacer (40) could have a pair of slots or the slot may extend between the sides (47). As an additional option, the spacer 40 may be formed without any slots extending therethrough.

Each of the tubular filters (50) which are shown in FIG. 1 are typically formed as a subassembly with the pin (30). The tubular (50) filter may consist of a ferrule, overlaid with a barrium titanate cylinder which is metallized on the inside and outside. Both ends of the sleeves are electroplated along the outer diameter. The pin (30) is soldered inside the filter element (50). It should be understood that while the filter element has been disclosed here as being of a certain composition, other filter elements well known in the art formed of other compositions would be equally suitable for surrounding the pins (30).

Figure 2:
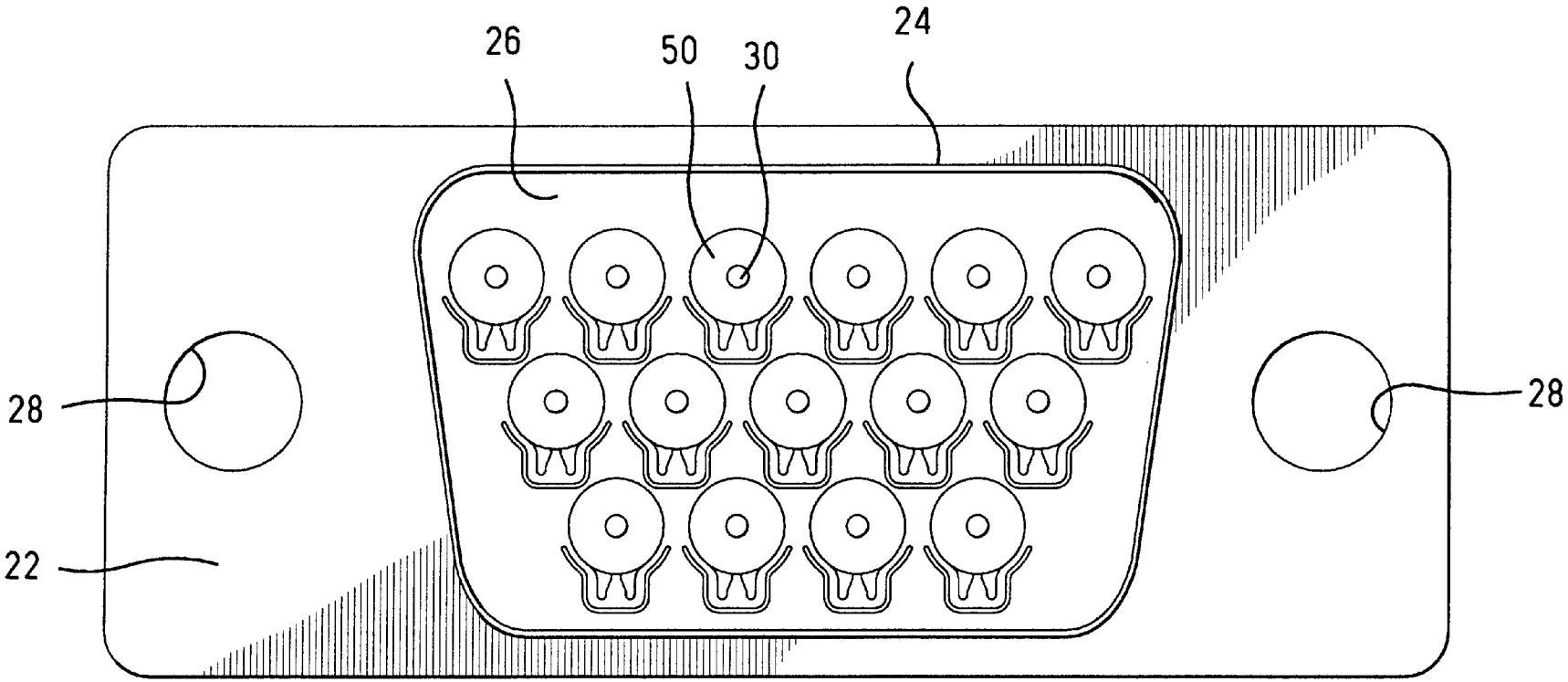
FIG. 2 shows a front end view of an electrical connector of FIG. 1.

Assembly of the electrical connector (10) will now be described in greater detail with reference to FIGS. 1 and 2. First, the ground planes (60) of FIG. 3 are assembled to the spacer (40) of FIG. 4. This assembly process can be accomplished by inserting a ground plane (60) into slot formed in the spacer (40). Alternately, a plurality of a spacers (40) without slots may be used to sandwich the ground planes (60) therebetween. The ground plane (60) and spacer (40) are inserted into the interface area (26) such that the ground plane (60) makes electrical contact along at least one edge with the mating section (24). Contact and filter subassemblies (30), (50) are then inserted into respective contact receiving passages (44), (64) such that the contact tips (63) each engage the outer diameter of a respective filter element (50). Upon insertion of the filter element (50) and engagement with the contact tip (63), the contact section (65) deflects to the position shown in FIG. 1. This will cause a torsional load on the torsional sections (69) so that the contact section (65) urges each contact and filter element subassembly (30), (50) towards its respective reference surface(66). It should be understood that the spring member (68) undergoes both torsional and cantilever deformation upon contact insertion.

It should be understood that electrical connector assembly (10) shown here may then be assembled to an insulative housing having electrical contacts which mate with the pins (30). The housing may be assembled to face plate (22) in a conventional manner. A housing assembly is not shown here because a variety of housings may be utilized such as a right angle insulative housing or a simple straight through insulative housing.

Figure 5:
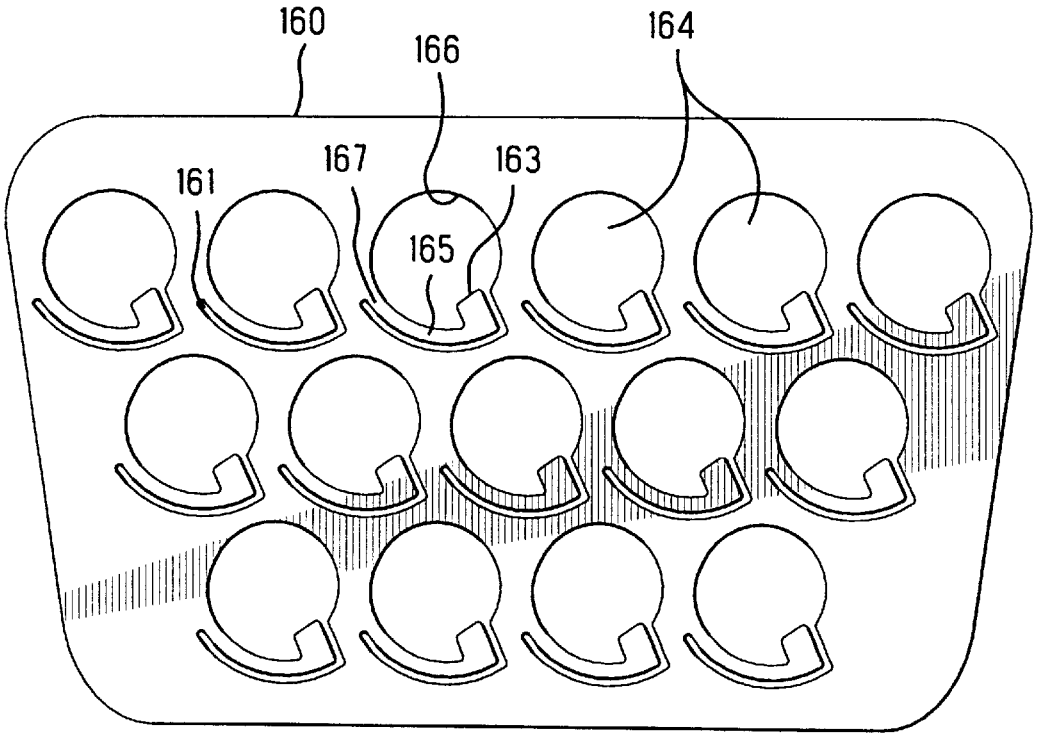
FIG. 5 shows an alternate ground plane similar to that of FIG. 3.

A first alternate ground plane (162) is shown in FIG. 5. A ground plane (160) is similarly formed of a sheet of conductive material and has a plurality of contact receiving openings (164). Spring members (165) extend adjacent each contact receiving opening (164) from an attachment point (167). Each spring member is defined by a contact receiving opening (164) and a slot (161) and is disposed therebetween. A contact point (163) extends into the contact receiving opening (164) from the spring member (165). A reference surface (166) is disposed inside the contact receiving opening (164) opposite the contact point (163). This spring member (165) also undergoes simultaneous cantilever beam and torsional deformation upon insertion of the filter element (50) to urge it against the reference surface (166).

Figure 6:
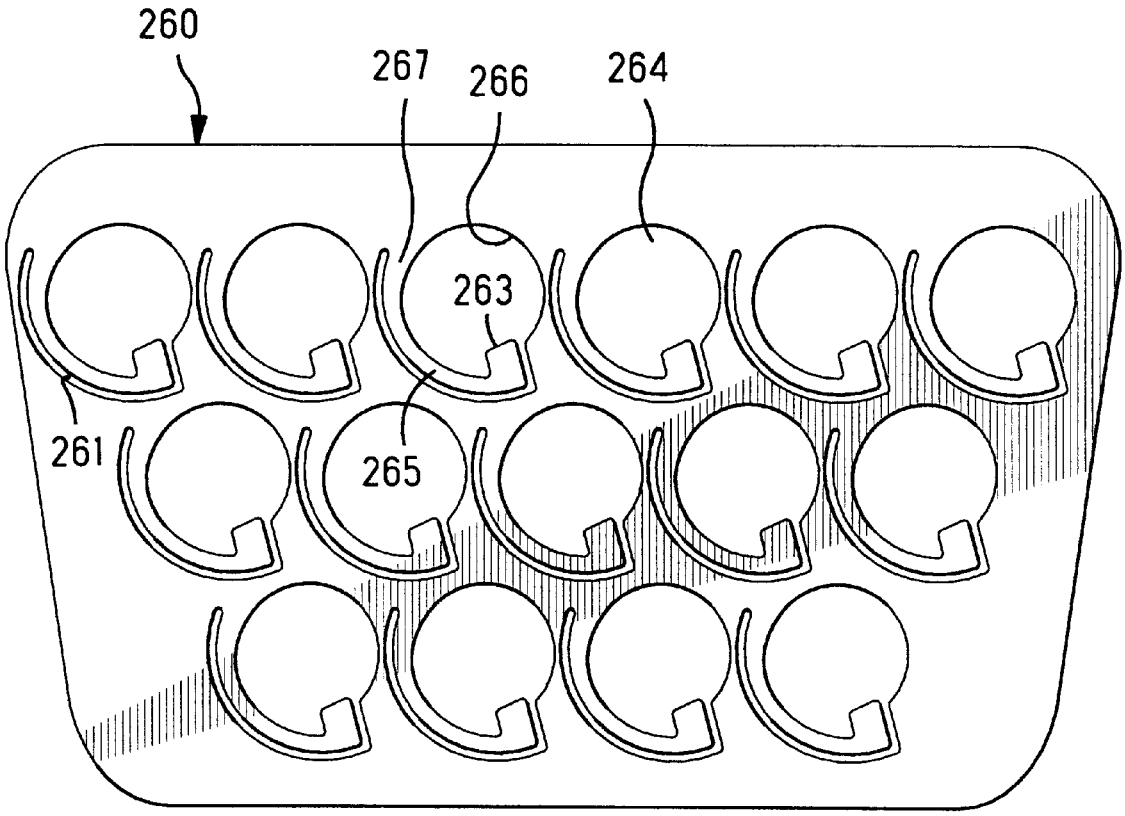
FIG. 6 shows a second alternate ground plane configuration similar to FIG. 3.

FIG. 6 shows yet another alternate embodiment of a ground plane (260) having a plurality of contact receiving openings (264) and a spring member (265) extending from an attachment point (267) adjacent each contact receiving opening (264). Spring member (265) is defined by a contact receiving opening (264) and a slot (261) and is disposed therebetween. A contact point (263) similarly urges the filter component (50) against a reference surface (266). The spring member (265) differs from a spring member (165) in that it is wider at the attachment point (267) than in the vicinity of the contact point (263). This will effect the spring properties and result in different cantilever and torsional deformations. It therefore should be understood that the shape and size of the spring contact (65), (165), (265) can be varied to achieve the appropriate spring property depending on such factors as the number of ground planes inside the connector, the size and the mass of each filter element (50), the tolerance in diameter of the filter element (50), the surface area required of the contact point (63), (163), (263), and other design considerations.

An advantage of the present invention is that it provides a simply stamped ground plane which biases each filter element and pin assembly against reference surfaces to assure proper pin to pin alignment.

An additional advantage of the present invention is that it provides a reliable electrical connection between each filter element and an outer metallic housing or shield member. It should be understood that while this invention is shown here embodied by the attached drawings and description, variations which would be obvious to one skilled in the art are intended to be within the scope of the invention and therefore the scope of the invention is intended to be limited only by the attached claims.

I claim:

1. A ground plane for use in a filtered electrical connector wherein said ground plane comprises:

a sheet of conductive material having a plurality of contact receiving openings formed therein, wherein each contact receiving opening comprises at least one spring member, said spring member being configured to undergo cantilever and torsional deflection upon insertion of a filter element into the contact receiving opening.

2. The ground plane as recited in claim 1 wherein each spring member comprises a cantilever beam.

3. The ground plane as recited in claim 2 wherein each cantilever beam extends along a side of the contact receiving opening, and each cantilever beam is attached to the ground plane at one end and has a contact point disposed adjacent the free end.

4. The ground plane as recited in claim 1 wherein the spring member is generally W-shaped.

5. The ground plane as recited in claim 4 wherein the spring member has a contact tip disposed between a pair of attachment points.

6. The ground plane as recited in claim 5 wherein the spring member further comprises a pair of torsional sections disclosed between the attachment points and the contact section.

7. A filtered electrical connector having a conductive outer shell, a ground plane being electrically connected to the outer shell and extending within the outer shell, a plurality of contacts disposed within the shell and a plurality of filter elements each being disposed between a respective contact and the ground plane, wherein the ground plane comprises a plurality of contact receiving openings each having at least one spring member, said spring members being configured to undergo cantilever and torsional deflection upon insertion of a filter element into the contact receiving opening.

8. The filtered electrical connector as recited in claim 7 wherein each spring member comprises at least one torsional section extending from an attachment point; and a contact tip spaced apart from the attachment point.

9. The filtered electrical connector as recited in claim 8 wherein each contact tip is disposed between a pair or tortional sections.

10. The filtered electrical connector as recited in claim 8 wherein each contact tip is disposed at a free end of a respective tortional section.

11. A ground plane for use in a filtered electrical connector, wherein said ground plane comprises:

a sheet of conductive material having a plurality of contact receiving openings formed therein, wherein each opening comprises at least one spring member, said spring member being disposed between said contact receiving opening and a slot in said sheet, wherein said spring member is configured to undergo cantilever and torsional deflection upon insertion of a filter element into the contact receiving portion.

12. The ground plane as recited in claim 11, wherein said spring member comprises a cantilever beam.

13. The ground plane as recited in claim 12, wherein said cantilever beam extends along a side of the contact receiving opening, and said cantilever beam is attached to the ground plane at one end and has a contact point disposed adjacent to the free end.

14. The ground plane as recited in claim 13, wherein the spring member is generally W-shaped.

15. The ground plane as recited in claim 14, wherein the spring member has a contact tip disposed between a pair of attachment points.

16. The ground plane as recited in claim 14, wherein the spring member further comprises a pair of torsional sections disposed between the attachment points and the contact point.

* * * * *